US006941601B2

(12) United States Patent
DeBartolo et al.

(10) Patent No.: US 6,941,601 B2
(45) Date of Patent: Sep. 13, 2005

(54) PILLOW WITH INSULATIVE BEVERAGE HOLDER

(76) Inventors: Jody L. DeBartolo, 529 Middlebury La., Elk Grove Village, IL (US) 60007; Terrence L. DeBartolo, 8 Lonsdale Rd., Elk Grove Village, IL (US) 60007

( * ) Notice: Subject to any disclaimer, the term of this patent is extended or adjusted under 35 U.S.C. 154(b) by 69 days.

(21) Appl. No.: 10/287,968

(22) Filed: Feb. 6, 2003

(65) Prior Publication Data

US 2004/0155047 A1 Aug. 12, 2004

(51) Int. Cl.[7] ..... A47C 20/00
(52) U.S. Cl. ..... 5/639; 220/737; 220/739
(58) Field of Search ..... 5/639; 220/737, 220/739; 248/311.2, 314, 309.1, 346.3, 910, 146

(56) References Cited

U.S. PATENT DOCUMENTS

| | | | | | |
|---|---|---|---|---|---|
| 2,293,530 | A | * | 8/1942 | Beehler | 190/102 |
| 2,649,900 | A | | 8/1953 | Pfankuch | |
| 3,118,152 | A | * | 1/1964 | Talley, Jr. | 5/631 |
| 3,139,632 | A | * | 7/1964 | Johns | 5/484 |
| 3,216,035 | A | * | 11/1965 | Gaudry | 15/49.1 |
| 3,276,046 | A | * | 10/1966 | Capelli | 8/205 |
| 4,021,872 | A | * | 5/1977 | Powell | 5/722 |
| 4,116,310 | A | * | 9/1978 | Shields | 224/576 |
| 4,227,270 | A | | 10/1980 | Rivera | |
| 4,508,044 | A | | 4/1985 | Downey et al. | |
| 4,681,239 | A | | 7/1987 | Manns et al. | |
| 4,819,287 | A | * | 4/1989 | Halverson | 5/710 |
| 4,858,084 | A | | 8/1989 | Sheryll | |
| 5,273,182 | A | | 12/1993 | Laybourne | |
| 5,367,731 | A | * | 11/1994 | O'Sullivan | 5/645 |
| 5,572,758 | A | | 11/1996 | Merritt | |
| 5,655,742 | A | | 8/1997 | Whitman | |
| 5,732,999 | A | * | 3/1998 | Petrie | 297/136 |
| 5,915,561 | A | | 6/1999 | Lorenzana | |
| 6,277,422 | B1 | | 8/2001 | Gale | |
| 6,371,428 | B1 | | 4/2002 | Zorich et al. | |
| 6,622,325 | B1 | * | 9/2003 | Garza | 5/636 |
| 2002/0104845 | A1 | | 8/2002 | Beuke et al. | |

* cited by examiner

*Primary Examiner*—Joseph C. Merek
(74) *Attorney, Agent, or Firm*—Meroni & Meroni, P.C.; Charles F. Meroni, Jr.; Christopher J. Scott

(57) ABSTRACT

This invention concerns a pillow in combination with a hot/cold insulative drink holder, the combination comprising a center mounted insulative drink holder projecting into one side of the pillow, and stitching for securing the insulative drink holder in integral assembly with the pillow. The insulative drink holder thus defines beverage vessel-receiving socket structure with an inside surface of the socket being insulated to preserve preexisting temperature of fluid in a beverage vessel when the same is lodged in the beverage receiving socket structure.

24 Claims, 11 Drawing Sheets

PILLOW WITH INSULATIVE BEVERAGE HOLDER

BACKGROUND OF THE INVENTION

1. Field of the Invention

The present invention generally relates to insulative beverage holders. More particularly, the present invention is primarily intended for consumers who wish to keep beverages either hot or cold by placing the beverage container into an insulative orifice or pocket in a pillow. The present invention thus further enables users to place the pillow or insulative beverage holder or on a variety of irregular surfaces and further provides users with a comfortable arm rest.

2. Description of the Prior Art

The prior art comprises myriad insulated beverage holders which are designed or have been developed to allow for the simultaneous holding of a beverage and the maintenance of the beverage temperature. The prior art further comprises pillows or cushions of many different types as well as a sizeable number of methods to allow for proper cushioning. The prior art combining or simultaneously touching on these general fields of art are fewer in number. Some of the art touching on these general fields of art is described hereinafter.

U.S. Patent Application Publication No. 2002/0104845 ('845 Publication), filed by Beuke, discloses a Highly Adaptable Thermal Insulator for Adapting to an Unprecedented Range of Sizes and Shapes of Beverage Containers. The Thermal Adaptor comprises a tubular insulator with open ends that are formed from two elastic panels. Each panel has straight top and bottom edges with elastic hems. The side edges of each panel are slightly curved to maintain the properties and proper appearance of the insulator. To form the insulator, two of the panels are joined along their side edges to form a tube. The insulator is placed around a beverage container to better insulate the container and maintain the temperature of the beverage located therein. The insulator accommodates significant variation in the size and shape of beverage containers.

U.S. Pat. No. 6,371,428 ('428Patent), which issued to Zorich et al., discloses a Collapsible Beverage Container Holding Device. The Collapsible Beverage Container Holding Device is designed to facilitate the ability to position the holder conveniently and securely at a seat or couch cushion or bed mattress level. The holder is designed to be packaged as a flat folded piece of material, typically plastic or the like, that can be unfolded and assembled in a simple fashion. Once assembled, a mounting portion of the base is slid under the seat or couch cushion or bed mattress with the beverage receiving portion protruding therefrom.

U.S. Pat. No. 6,277,422 ('422 Patent), which issued to Gale, discloses A Beverage Container and Closure Therefor Which Can Serve as a Coaster. The Beverage Container and Closure Therefor comprises a bowl having a generally hemispherical base and an axis and an upstanding wall circular in cross-section adjoining the generally hemispherical base and being inclined upwardly and inwardly to define a circular lip lying in a plane which is perpendicular to the axis of the hemispherical base and providing an opening providing access to a space within the bowl. The closure comprises a circular rim lying in a plane and having a wall circular in cross-section adjoining the rim and extending downwardly and outwardly and being sized to cover the opening of the container. A cooperative seal is carried by the closure and the container for forming an air tight seal between the rim of the closure and the lip of the bowl. A band secures the closure to the container to maintain a sealing engagement between the o-ring and the closure and the o-ring and the bowl.

U.S. Pat. No. 5,915,561 ('561 Patent), which issued to Lorenzana et al., discloses a Lap Tray. The Lap Tray comprises an elongated body portion to be supported across the upper legs of a seated person providing recessed areas for food and beverage containers and having downwardly extending vertical projections at the ends of the body portion to engage the outer thighs to retain the tray in a supporting position.

U.S. Pat. No. 5,572,758 ('758 Patent), which issued to Merritt, discloses a Combination Seat Cushion and Cheering Aid. The Combination Seat Cushion and Cheering Aid comprises a hand hole for carrying convenience, particularly at sporting events. IN order to demonstrate enthusiasm for a particular contestant or team, the item is held overhead for use as a portable, handheld display sign or billboard. An imprint might be used for showing support for a particular athlete. The faces of the cushion may be imprinted with insignia of a team such as a university or professional sport team. An alternate embodiment has a hand hole adapted to receive a beverage cup.

U.S. Pat. No. 5,273,182 ('182 Patent), which issued to Laybourne, discloses a Coaster. The Coaster is designed for use with a beverage can, bottle or other container with the coaster providing an absorbent member having a seat sized to receive the bottom or foot of the container and a multiplicity of interconnected capillary spaces sized to receive and safely retain any moisture present or forming as condensate on an running or dripping from the container. Fixed relative to the absorbent member is a coupling member having a series of semi-resilient contact elements positioned to releasably engage the container and couple the coaster to the container as the container is placed on the coaster. The coaster thus remains on the container as it is picked up and moved about by one consuming beverage from the container.

U.S. Pat. No. 4,227,270 ('270 Patent), which issued to Rivera, discloses a Combined Baby Pillow Case and Bottle Holder. The Combined Baby Pillow Case and Bottle Holder comprises a pillow case having a receptacle upon its upper side in which a baby bottle is retained during a time of nursing, and the pillow case upper side including a sideward extending flap upon which a baby rests its head while sucking on the bottle nipple.

It will thus be seen that none of the prior art provides a pillow with an insulative beverage container-holding orifice or socket structure for maintaining an inserted beverage container in a substantially upright position, which socket structure further maintains the beverage temperatures. The prior art thus perceives a need for a pillow with an insulative beverage container-holding orifice or socket structure for maintaining an inserted beverage container in a substantially upright position, which socket structure further maintains the beverage temperatures. What is essentially needed is a product for supporting a beverage container upright on a variety of non-uniform, non-flat, flat, and non-planar surfaces that also provides for insulating the beverage container.

Accordingly, it is a principal object of our invention to provide an insulated or insulative beverage container within a pillow to assist in minimizing any change of temperature of liquid contents of the container.

It is a further object of our invention to provide a broad base to the pillow such that it may conform to a variety of different non-uniform, non-flat, and non-planar surfaces.

It is a still further object of our invention to provide an insulated beverage holder that may maintain the temperature of the beverage container and the beverage that the container is holding.

It is a further object of our invention to provide for positioning a socket structure which is the insulated beverage container within the center of the pillow such that the pillow may also provide comfortable support for a user's arm.

It is a still further object of our invention to provide for a decorative pillow on the side opposite the opening to the insulated beverage container.

Other objects of our invention, as well as particular features, elements, and advantages thereof, will be elucidated in, or apparent from, the following description and the accompanying drawing figures.

SUMMARY OF THE INVENTION

According to our present invention we have provided a pillow with at least one insulative beverage container-holding socket or orifice projecting into one side of the pillow.

In the preferred embodiment, we have provided stitching, which secures the insulative beverage container-holding socket or orifice in integral assembly with the pillow. Further, as suggested, the insulative beverage container-holding orifice defines an inwardly opening beverage vessel-receiving socket structure with an inside surface of the socket structure being lined with insulative materials to preserve preexisting temperature of fluid in a beverage vessel when lodged in the inwardly opening beverage vessel-receiving socket structure.

Further, we have provided a method of manufacturing a pillow having an insulative beverage container-holding socket or orifice. Additionally, we have provided a method of converting a preexistent pillow into a pillow having an insulative beverage container-holding socket.

DESCRIPTION OF THE DRAWINGS

Other features of our invention will become more evident from a consideration of the following detailed description of our patent drawings, as follows:

FIG. 19(*b*) is a perspective view of a pillow with pillow fill material repositioned to receive a socket structure.

FIG. 19(*c*) is a perspective view of a pillow encased in a pillow slip having a socket structure and an open end with zipper means for closing the open end.

FIG. 19(*d*) is a perspective view of a pillow having an insulative beverage container-holding socket structure.

DETAILED DESCRIPTION OF THE PREFERRED EMBODIMENT

Figure 1:
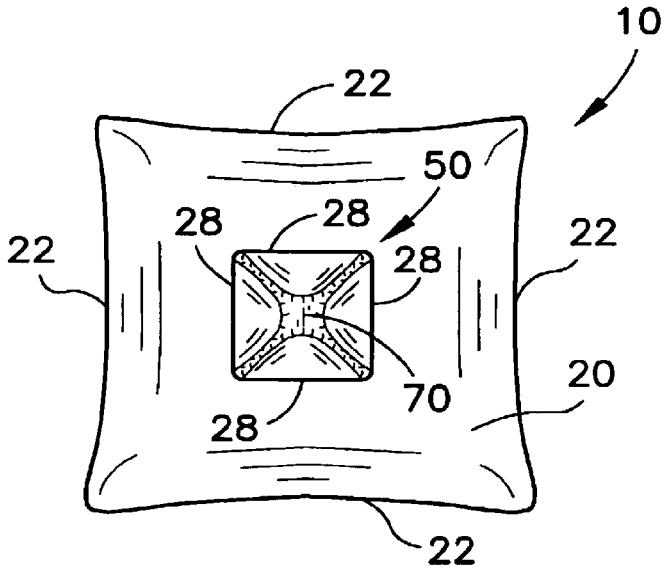
FIG. 1 is a top plan view of a pillow with insulative beverage container-holding structure.

Referring now to the drawings, the preferred embodiment of the present invention concerns a pillow with a single, substantially centered, insulative beverage container-holding orifice or an insulated drink holder projecting into one side of the pillow as illustrated in FIGS. 1, and 4–7.

Figure 2:
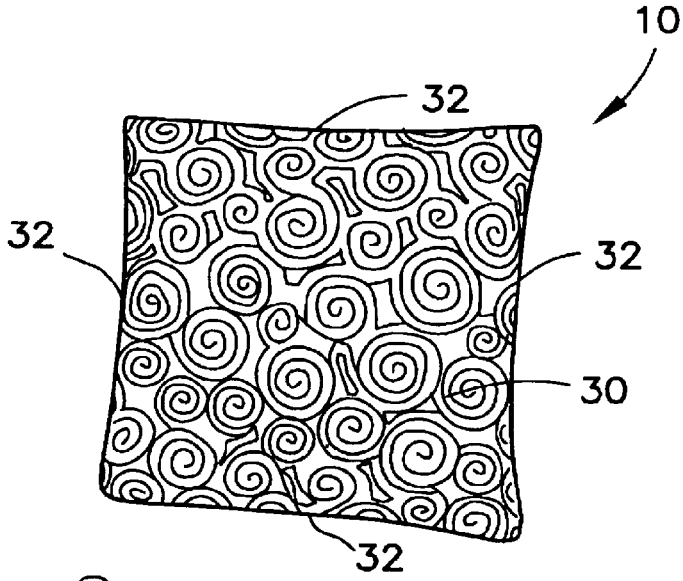
FIG. 2 is a bottom plan view of the pillow illustrated in FIG. 1.
Figure 3:
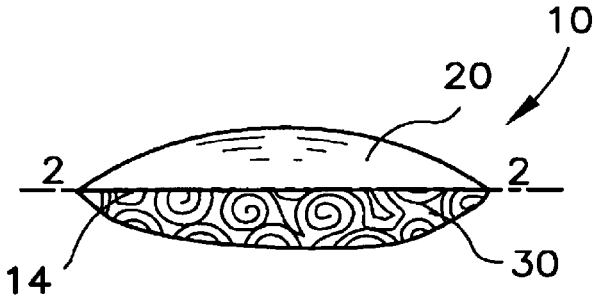
FIG. 3 is a side plan view of the pillow illustrated in FIG. 1.

As earlier described, FIG. 1 is a top plan view of a pillow with insulative beverage container-holding structure; FIG. 2 is a bottom plan view of the pillow illustrated in FIG. 1; and FIG. 3 is a side plan view of the pillow illustrated in FIG. 1. Together, FIGS. 1–3 show the outer surfaces of a typical pillow 10 with a beverage container-holding orifice or socket structure, the socket structure 50 being specifically illustrated in FIG. 1 as well as FIGS. 4–7, 14, 16, 18, 19(*c*), and 19(*d*).

Figure 4:
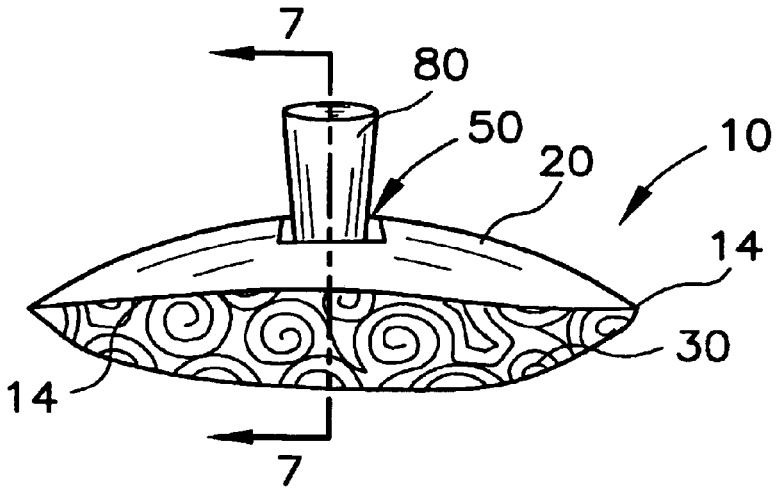
FIG. 4 is a side view of a pillow with insulative beverage container-holding orifice with a disposable beverage cup being inserted into the insulative beverage container-holding structure.
Figure 5:
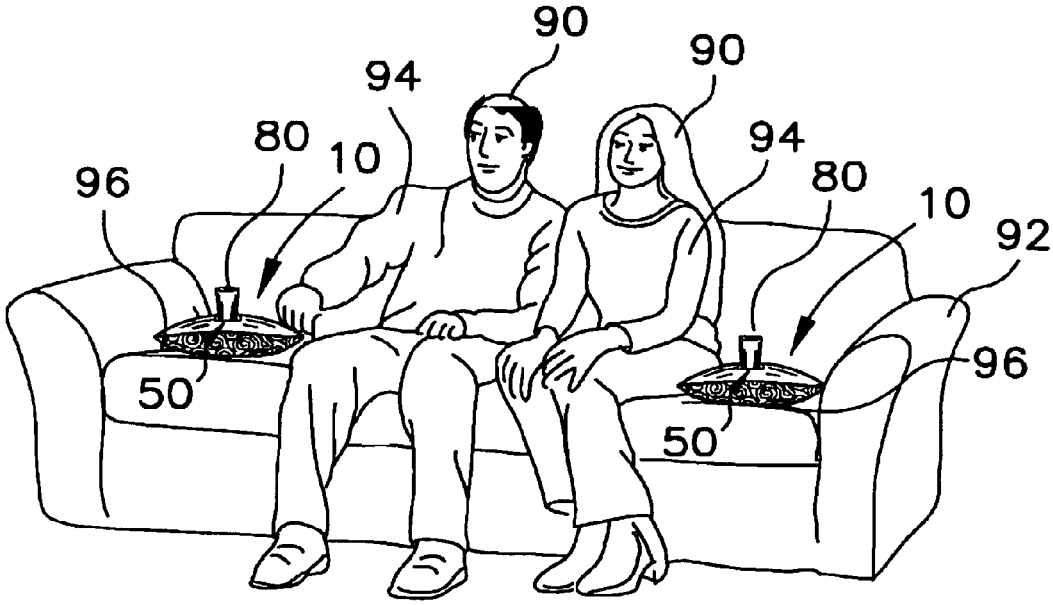
FIG. 5 is a perspective view of two pillows with insulative beverage container-holding structure in use.

Pillow 10 is specifically illustrated in FIGS. 1–6. FIG. 4 shows pillow 10 holding a beverage container 80 in a substantially upright orientation such that the beverage contained by the beverage container is prevented from spilling upon pillow 10. Beverage container 80 is further illustrated in FIGS. 5 and 7. FIG. 5 shows two separate pillows 10 as they may be used by two human beings 90 while sitting upon a couch 92 with a non-planar surface 96. As will be seen in FIG. 5, pillow 10 may be placed upon non-planar surface 96 with beverage container 80 held in socket structure 50. Pillow 10 is designed to hold beverage container 80 stable and upright with regard to non-planar surface 96. Additionally, it is contemplated that pillow 10 is designed to hold beverage container 80 stable and upright when pressure is exerted upon pillow 10 by the arm 94 of a human being as further illustrated in FIG. 5.

As illustrated in FIGS. 1, 3, 4, 6, 7 and 15–18, pillow 10 comprises a top sheet 20. As illustrated in FIGS. 2–4, 6, 7, 15–18 pillow 10 further comprises a base sheet 30. Preferably, top sheet 20 and bottom sheet 30 are constructed from pieces of fabric, although, it is contemplated that top sheet 20 and bottom sheet 30 may be constructed from a flexible plastic material.

Figure 6:
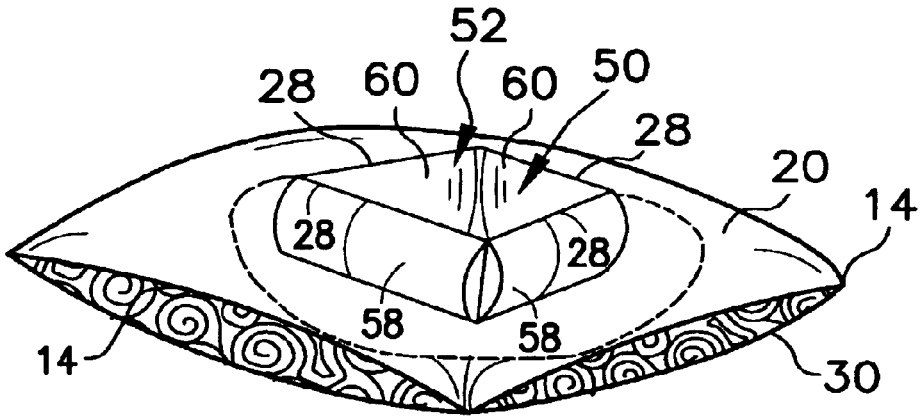
FIG. 6 is a perspective view of a pillow with parts removed to show the insulative beverage container-holding structure.
Figure 15:
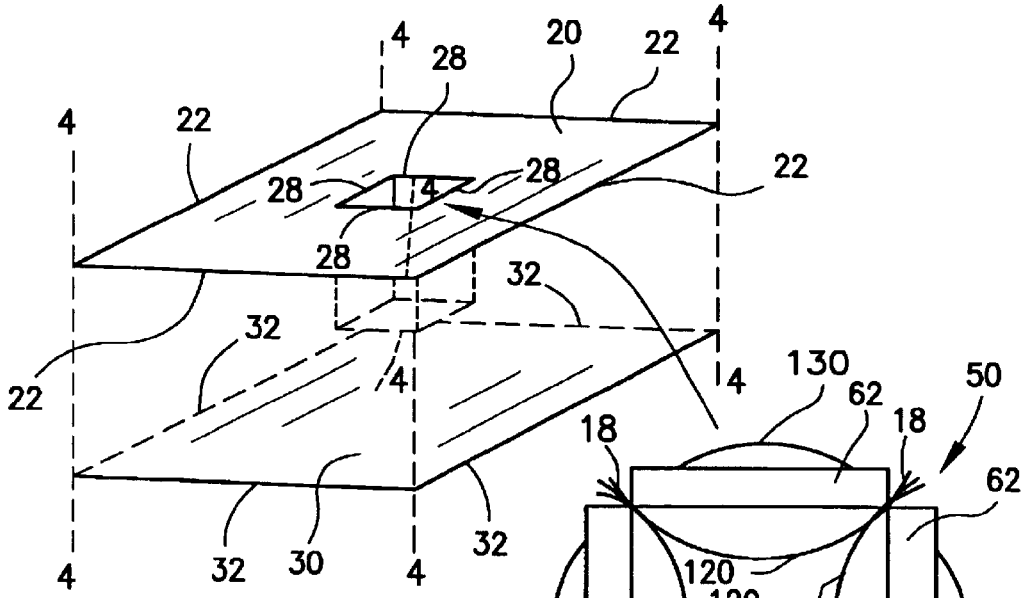
FIG. 15 is a perspective view of a top sheet and base sheet assembly in an disassembled state showing the preferred attachment location for the insulative beverage container-holding structure in the top sheet.
Figure 18:
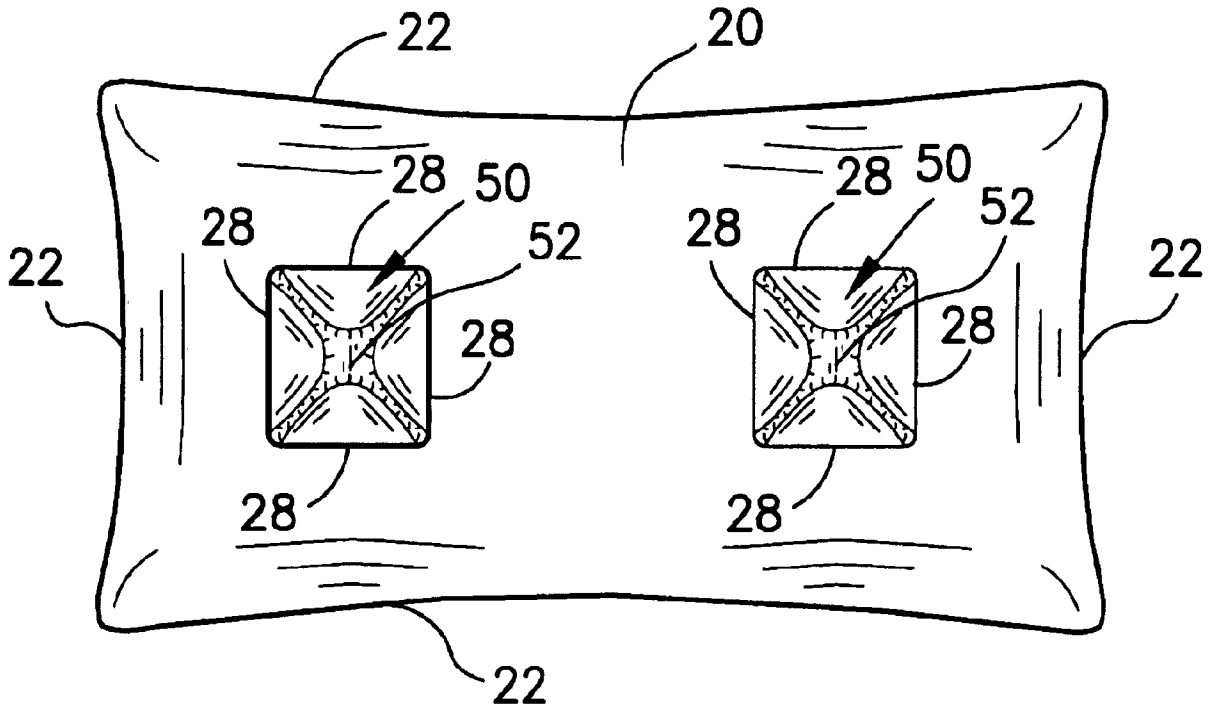
FIG. 18 is a top plan view of a pillow with two insulative beverage container-holding structures.
Figure 19A:
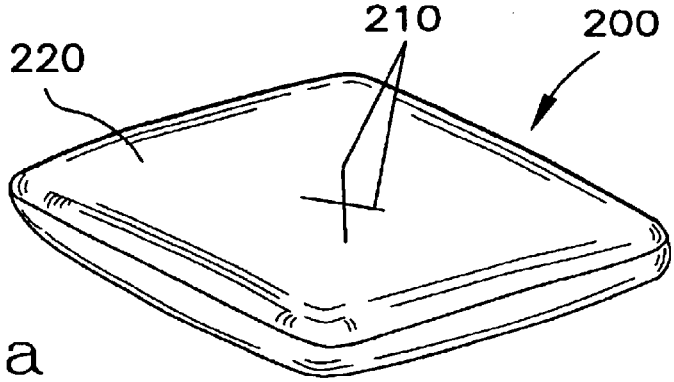
FIG. 19(*a*) is a perspective view of a pillow with two incisions made in the superior pillow surface.
Figure 19B:
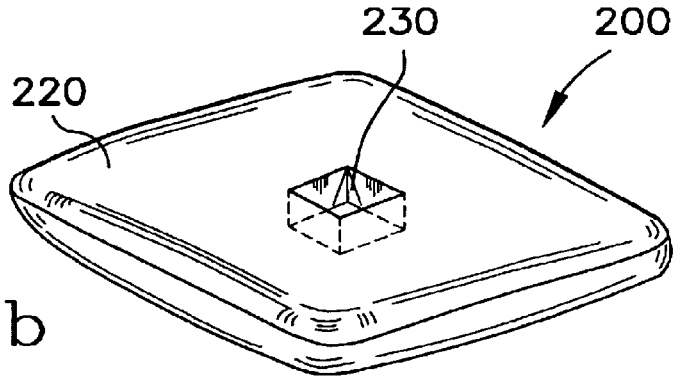
Figure 19C:
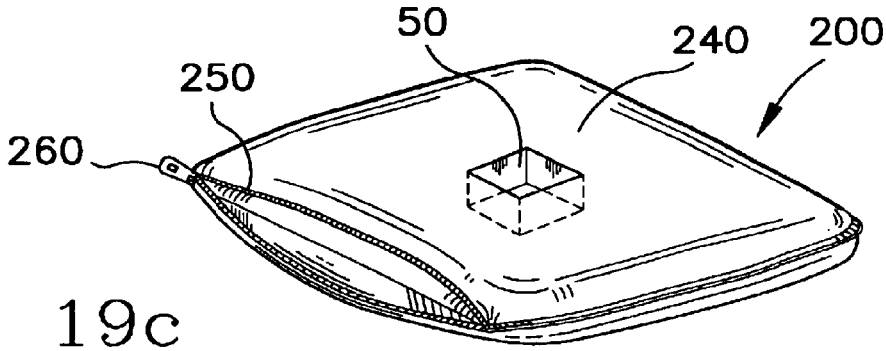
Figure 19D:
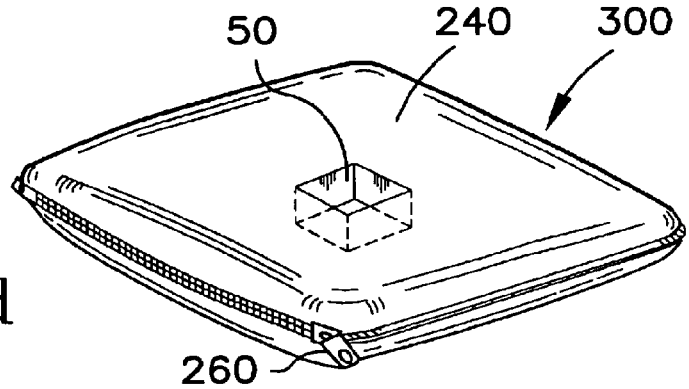

As illustrated in FIGS. 1, 15, and 18, top sheet 20 further comprises a top sheet outer periphery 22. As illustrated in FIGS. 2 and 15, bottom sheet 30 further comprises a base sheet outer periphery 32. Top sheet outer periphery 22 and base sheet outer periphery 32 are moved together along broken line lines referenced at 4 of FIG. 15 and joined at seam 14 as illustrated in FIGS. 3, 4 and 6. Top sheet outer periphery 22 and base sheet outer periphery 32 are thus preferably joined at seam 14 by fabric stitching. It is further contemplated, however, that top sheet outer periphery 22 may be joined to base sheet outer periphery 32 at seam 14 by other means of attachment known in the art, for example adhesive.

As illustrated in FIGS. 1–4, top sheet 20 and base sheet 30 are square in configuration when viewed from extreme superior or inferior views. It is to be understood that top sheet 20 and base sheet 30 may comprise virtually any two-dimensional shape when viewed from an extreme superior or inferior view and, in this regard for example, may comprise circular configurations. Further, top sheet 20 and base sheet 30 may comprise other suitable fanciful configurations, such as the outline of a school mascot and the like.

As illustrated in FIG. 3, top sheet 20 and base sheet 30 are preferably formed to be of approximately similar surface area creating a pillow 10 that is symmetrical about the broken line referenced at 2. It is further contemplated; however, that top sheet 20 may have a smaller surface area than base sheet 30, thus creating a pillow 10 that is not symmetrical about a side axis. In a similar fashion, it is further contemplated that top sheet 20 may have a larger surface area than base sheet 30, thus also creating a pillow 10 that is not symmetrical about a side axis.

As illustrated in FIGS. 1, 6, 15 and 18, top sheet 20 has an inner periphery 28 defining an opening located at approximately the center of top sheet 20. As generally illustrated in FIG. 4, the opening is sized to accommodate or receive beverage container 80. In the preferred embodiment, and as specifically illustrated in FIG. 1, inner periphery 28 is configured in a square pattern when viewed from an extreme superior viewpoint, but it is further contemplated that inner periphery 28 may alternatively comprise other patterns, for example, a circular pattern.

An insulative beverage container-holding orifice or drink holder or socket structure 50 is positioned between top sheet 20 and base sheet 30 at inner periphery 28 as illustrated in FIGS. 1, 4–7, 14, 16 and 18.

Figure 7:
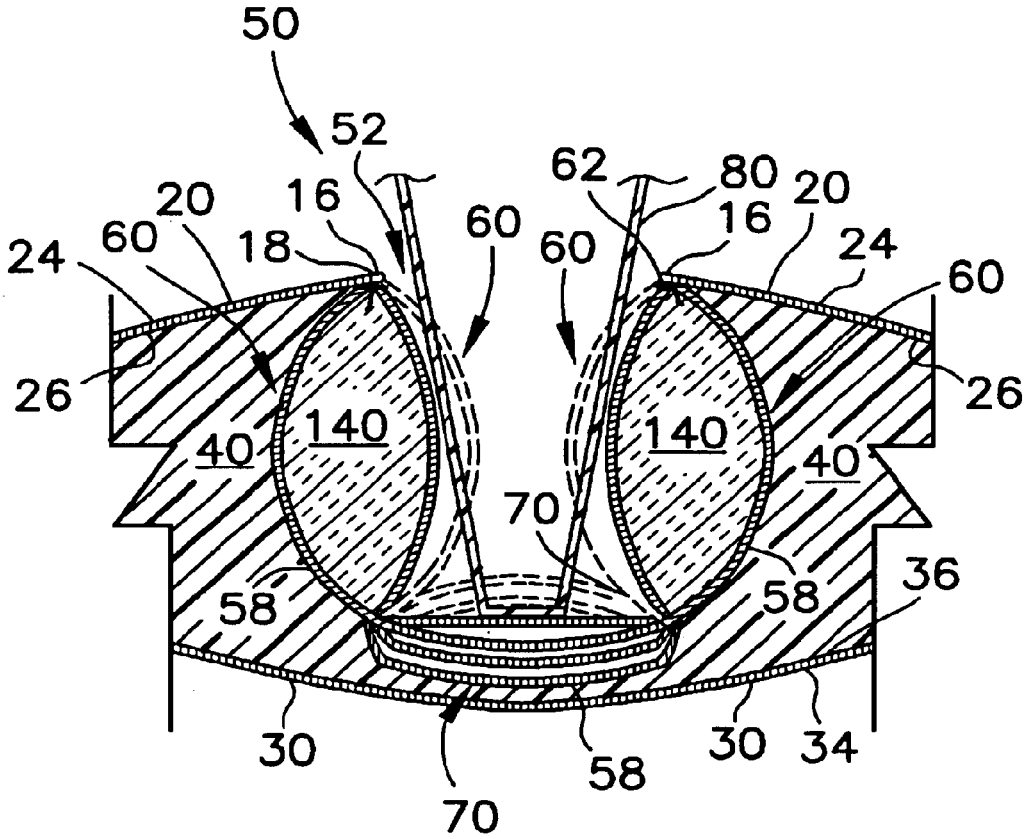
FIG. 7 is an enlarged, partial,-cross-sectional side view of the pillow illustrated in FIG. 4.

As illustrated in FIGS. 7, 8, 11–14, 16 and 17, socket structure 50 has a socket base 70. As illustrated in FIGS. 6–8 and 11–13, a socket sidewall 60 or pad member extends from socket base 70, and a socket opening or a superior open end 52 is defined by the socket sidewalls 60 when in a fully assembled state as illustrated in FIGS. 6 and 7.

Figure 16:
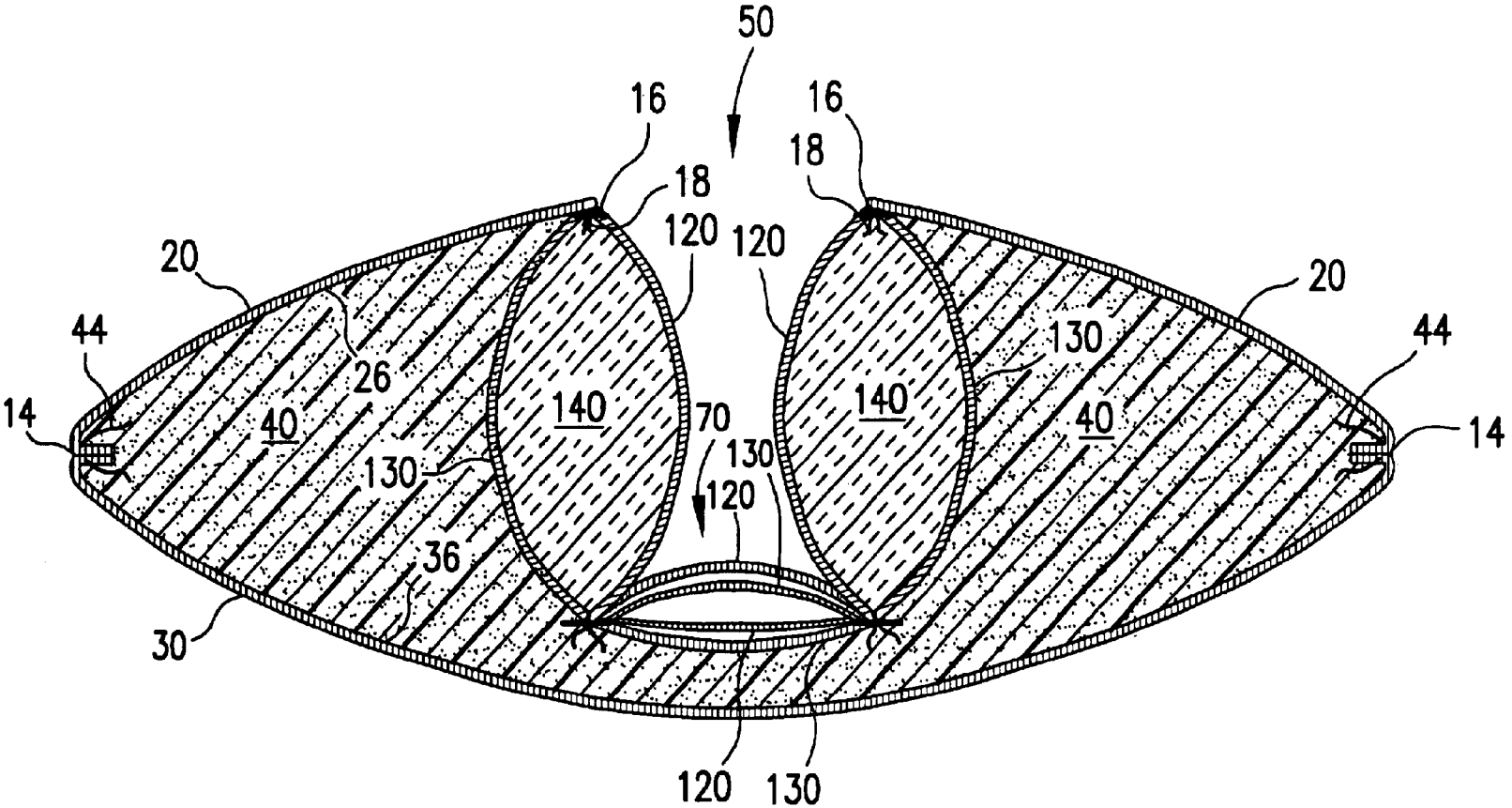
FIG. 16 is a cross-sectional side view of a pillow with insulative beverage container-holding structure in beverage container-receiving configuration.
Figure 17:
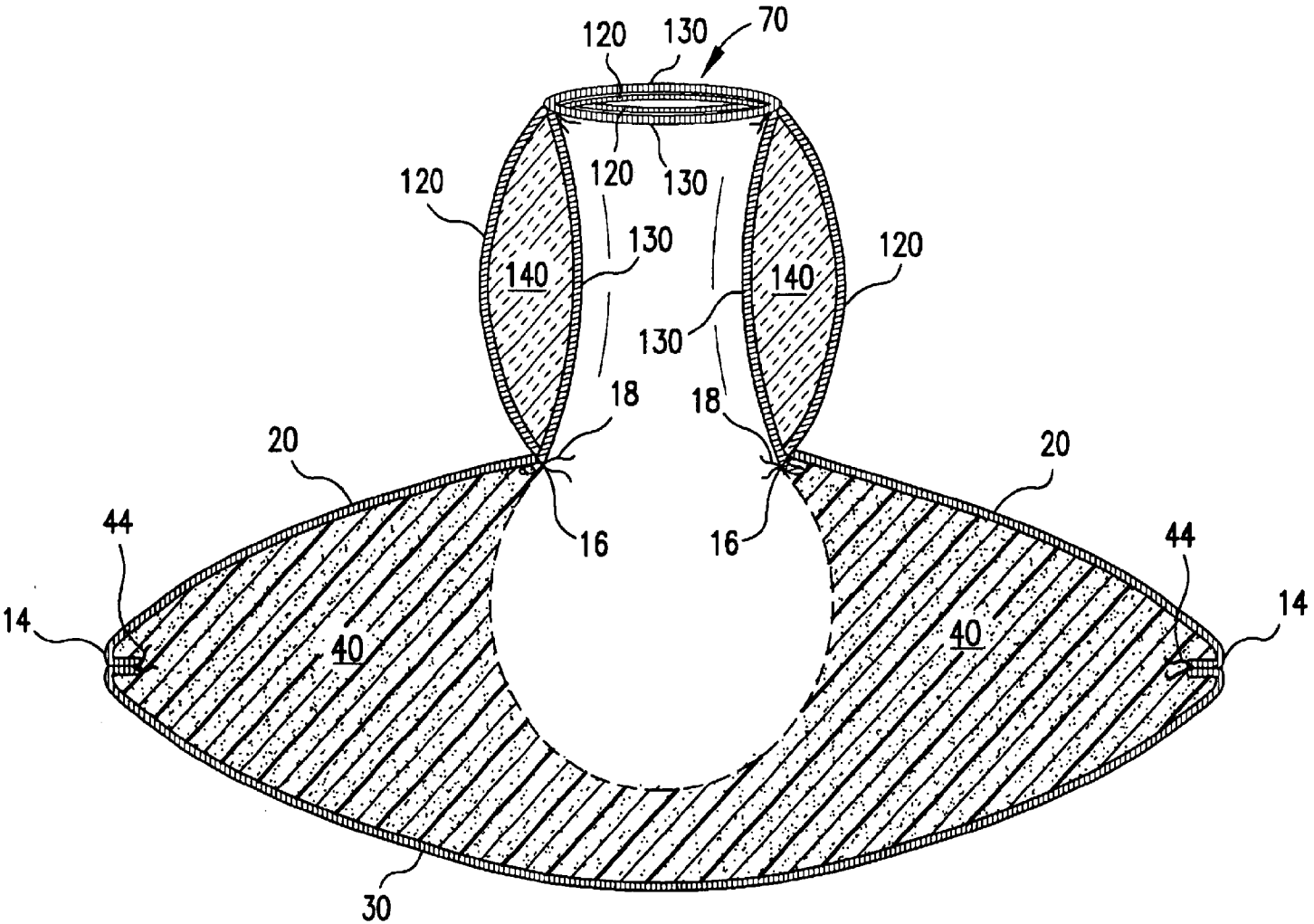
FIG. 17 is a cross-sectional side view of a pillow with insulative beverage container-holding structure in an inverted configuration.

Superior open end 52 is joined in integral assembly to top sheet inner periphery 28 at socket structure joining seam 16 as illustrated in FIGS. 7, 16 and 17. In the preferred embodiment, superior open end 52 is joined to top sheet inner periphery 28 at socket structure joining seam 16 by fabric stitching 18 as illustrated in FIGS. 7, 14, 16 and 17. It is further contemplated, however, that superior open end 52 may be alternatively joined to top sheet inner periphery 28 at socket structure joining seam 16 by other means of attachment known in the art, for example adhesive.

In the preferred embodiment and as illustrated in FIG. 16, socket base 70 is not fixedly attached to base sheet 30. This non-attachment allows socket structure 50 to be pulled out beyond top sheet 20 as illustrated in FIG. 17. As is illustrated in FIG. 17, socket structure 50 may be pulled out or inverted to enable easier cleaning by a user. It is further contemplated; however, that socket base 70 may be attached in integral assembly to base sheet 30 by means of attachment known in the art, for example stitching or adhesive.

As illustrated in FIGS. 7, 16 and 17, pillow 10 comprises a filling material 40. Filling material 40 functions to exert force against top sheet 20 at the inner top sheet surface 26 as illustrated in FIGS. 7 and 16. Filling material 40 further functions to exert force against base sheet 30 at the inner base sheet surface 36 as illustrated in FIGS. 7 and 16, and the outer socket surface 58 as illustrated in FIGS. 6 and 7. Outer socket surface 58 comprises the outer surfaces of assembled socket sidewalls 60 and the socket base 70. In the preferred embodiment, filling material 40 is a fiber material, but it is further contemplated that filling material 40 may alternatively be constructed from or comprise a foam or foam-like material. Further, it is contemplated that filling material 40 may comprise other filling material that achieves volume when contained in a closed container, for example air.

As illustrated in FIG. 7, top sheet 20 has an outer top sheet surface 24 and an inner top sheet surface 26. In the preferred embodiment, outer top sheet surface 24 comprises or is constructed from a plush decorative material. It is further contemplated; however, that outer top sheet surface 24 may comprise other similar suitable materials known in the art. In the preferred embodiment, inner top sheet surface 26 comprises or is constructed from a non-decorative material functioning to contain filling material 40. It is further contemplated; however, that inner top sheet surface 26 may comprise other suitable materials known in the art.

As further illustrated in FIG. 7, and in a similar fashion, base sheet 30 has an outer base sheet surface 34 and an inner base sheet surface 36. Preferably, outer base sheet surface 34 comprises or is constructed from a plush decorative material, but may comprise other suitable materials known in the art. Preferably, inner base sheet surface 36 comprises or is constructed from a non-decorative material, which functions to contain filling material 40, but which may also comprise other suitable materials known in the art.

As earlier described and as illustrated in FIG. 1 and in the cross-sectional view of FIG. 7, socket structure 50 lies amid top sheet 20 and base sheet 30. Socket structure 50 has a superior open end 52 and an inferior end or socket base 70. As illustrated in FIG. 12, socket structure 50 is preferably formed of four rectangular pad members 60 or sidewalls and a socket base 70. Each pad member 60 has a superior edge 62 as illustrated in FIGS. 8 and 11–14; an inferior edge 64 as illustrated in Figure Nos. and two side edges 66. Socket base 70 preferably comprises four peripheral edges 72. Socket structure 50 is formed by, first,joining an individual pad member inferior edge 64 with an individual socket structure base peripheral edge 72 in series as illustrated in FIG. 13, and second, joining two adjacent side edges 66 together as further illustrated in FIG. 13. This construction leaves the socket structure superior open end 52 with four pad superior edges 62 (illustrated in FIG. 14) for attachment to top sheet inner periphery 28.

In the preferred embodiment, the individual pad member inferior edge 64 is joined with an individual socket structure base peripheral edge 72 by fabric stitching. Alternatively, the individual pad member inferior edge 64 is joined with an individual socket structure base peripheral edge 72 by other means of attachment known in the art, for example adhesive.

In the preferred embodiment, one pad member side edge 66 is joined with another pad member side edge 66 by fabric stitching. Alternatively, pad member side edge 66 is joined with another pad member side edge 66 by other means of attachment known in the art, for example adhesive.

Each pad 60 is an integral assembly of a first piece 120 as illustrated in FIGS. 9, 10, 14, 16 and 17; a pad filling material 140 as illustrated in FIGS 7, 9, 10, 16 and 17; and a second piece 130 as illustrated in FIGS. 9, 10, 14, 16 and 17. Pad filling material 140 functions to exert force against first piece 120 and second piece 130. In the preferred embodiment, pad filling material 140 comprises hot/cold insulative materials. Alternatively, it is contemplated that pad filling material 140 may comprise fiber material, foam material, or other filling material known in the art that functions to fill the inner volume when contained in a closed container and further provides an insulative function, such as air.

Figure 9:
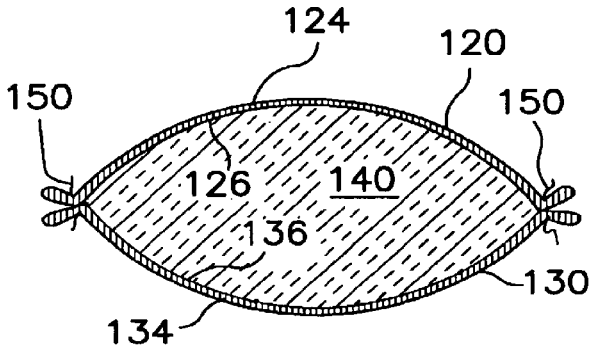
FIG. 9 is a cross-sectional end view of one hot/cold pad.
Figure 10:
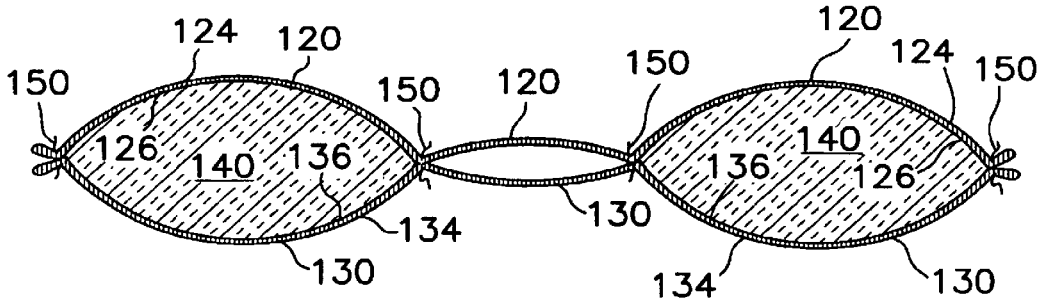
FIG. 10 is a cross-sectional side view of the hot/cold pad and base section assembly illustrated in FIG. 8.

First piece 120 has an outer first piece surface 124 as illustrated in FIGS. 9 and 10, and an inner first piece surface 126 as further illustrated in FIGS. 9 and 10. In the preferred embodiment, outer first piece surface 124 comprises or is constructed from a water resistant material. Alternatively, the outer first piece surface 124 may comprise other suitable materials known in the art. In the preferred embodiment, inner first piece surface 126 comprises or is constructed of material functioning to contain pad filling material 140. Alternatively, the inner first piece surface 126 may comprise other suitable materials known in the art.

In a similar fashion, second piece 130 has an outer second piece surface 134 as illustrated in FIGS. 9 and 10, and an inner second piece surface 136 as also illustrated in FIGS. 9 and 10. Preferably, outer second piece surface 134 comprises or is constructed from a non-decorative material, which functions to prevent filling material 40 to enter into the pad filling material 140. Alternatively, outer second piece surface 134 may comprise other materials known in the art. Preferably, inner second piece surface 136 comprises a non-decorative material, which functions to contain pad filling material 140. Alternatively, inner second piece surface 134 may comprise other materials known in the art.

Figure 8:
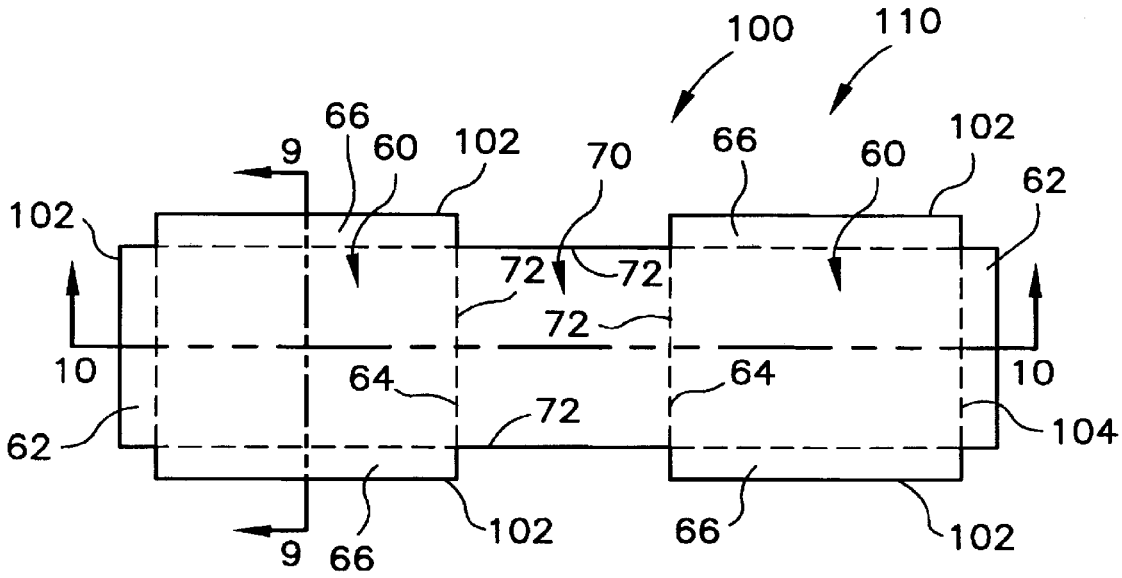
FIG. 8 is a top view of a hot/cold pad and base section assembly in a partially assembled state showing two hot/cold pads attached to a base section.
Figure 11:
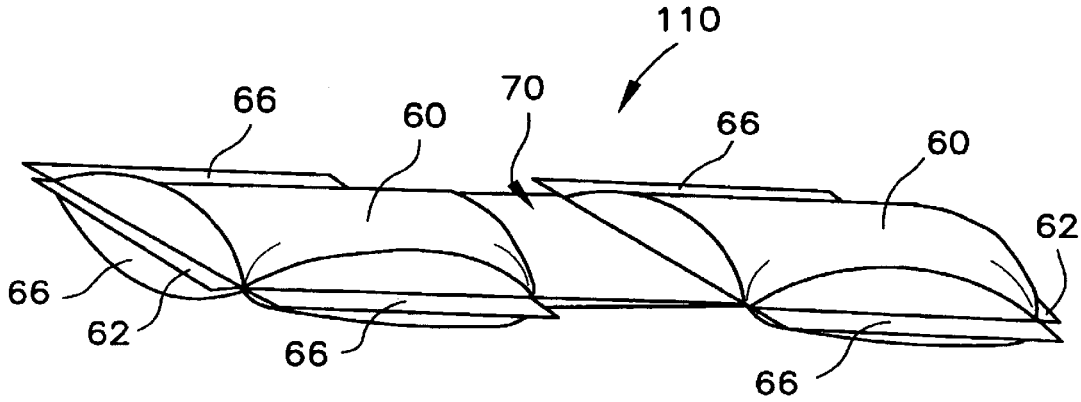
FIG. 11 is a perspective view of a hot/cold pad and base section assembly in a partially assembled state showing two hot/cold pads attached to a base section.
Figure 12:
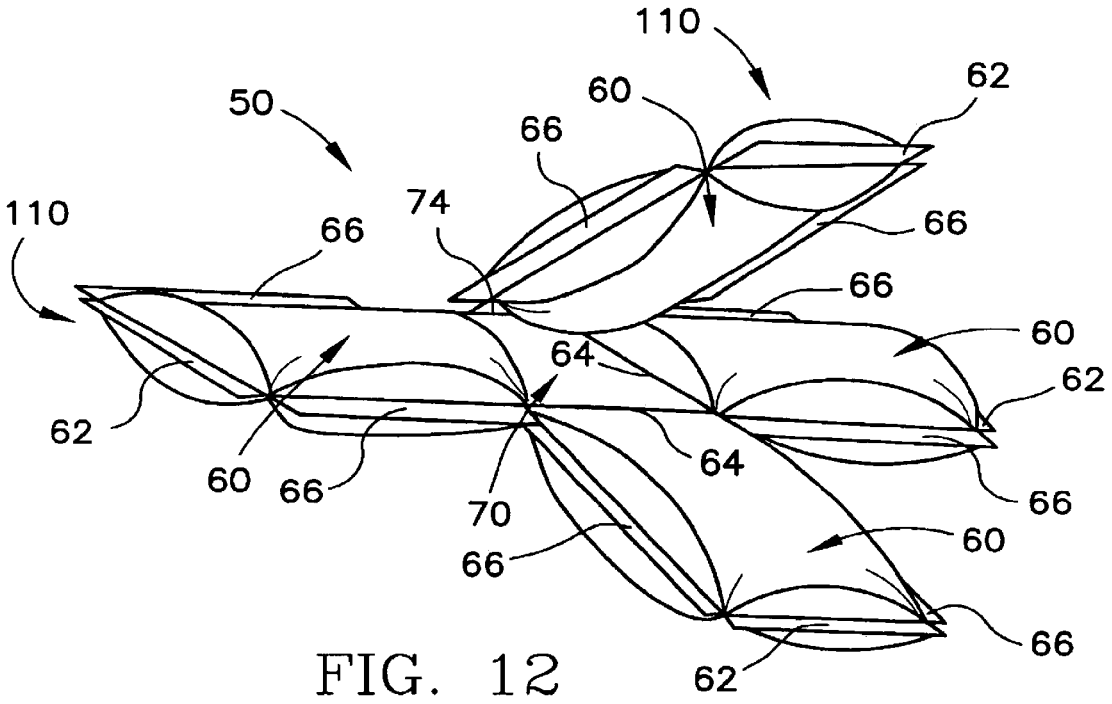
FIG. 12 is a perspective view of a socket structure in a partially assembled state showing a hot/cold pad and base section assembly with four hot/cold pads joined at the base section.
Figure 13:
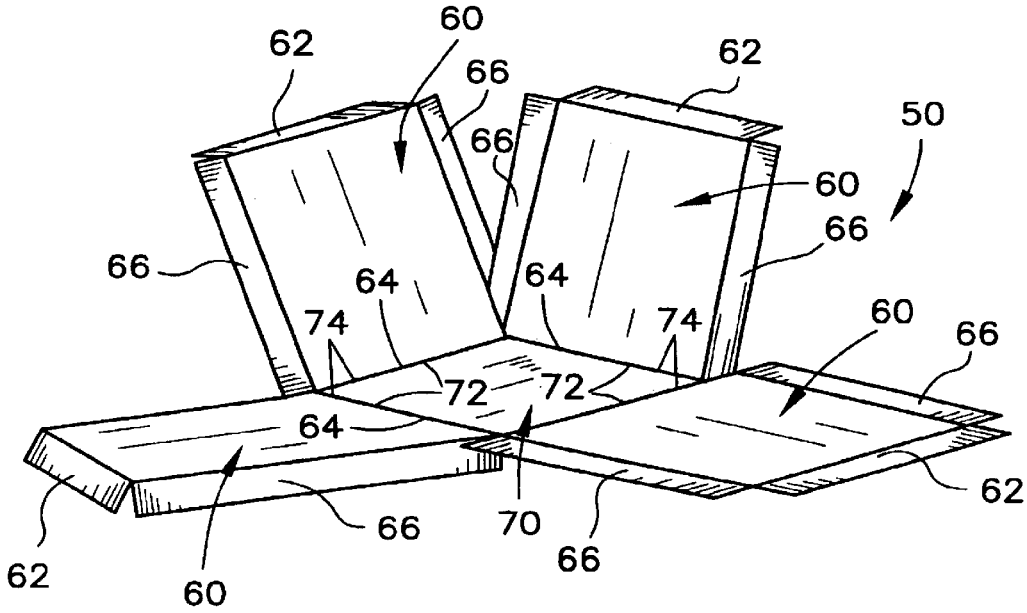
FIG. 13 is a schematic view of a socket structure in a partially assembled state showing a hot/cold pad and base section assembly with two adjacent hot/cold pad sections in a substantially vertical position for attachment to one another and two hot/cold pads in a substantially horizontal position.

FIGS. 11–17 generally show the preferred embodiment and the method of constructing the pillow with a beverage container-holding orifice or socket structure 50. A hot/cold pad and base section assembly 110 or a dual sidewall and base insulation piece, in a partially assembled state, is illustrated in FIGS. 8 and 11. FIGS. 8 and 11 show two laterally opposite hot/cold pad members 60 attached to a base section 70. The hot/cold pad members 60 are designed to preserve or maintain the temperature of liquids or fluids contained in beverage containers. A pattern 100 as generally represented by the top view of the hot/cold pad and base section assembly 110 as illustrated in FIG. 8, is used to simultaneously manufacture and join two pad members 60 and a socket base 70. Pattern 100 has an outer outline 102 as illustrated in FIG. 8 and an inner outline 104 as also illustrated in FIG. 8. Outer outline 102 defines the area of cutting a piece of material such as used for a pad first piece 120 and a pad second piece 130. Once each material is cut into the pattern of outer outline 102, the inner surfaces of the two materials are, aligned facing each other with pad filling material 140 lying between the two inner surfaces at the areas within inner outline 104. The two pieces are then joined together with stitching along the location of inner outline 104. Alternatively, the two pieces may be joined by other means of attachment known in the ant, for example adhesive.

As will be noted from a general inspection of FIG. 9, the end cross-sectional view demonstrates the form of the resulting construction as outlined in the above-described process. As will be noted from a general inspection of FIG. 10, the side cross-sectional view demonstrates the form of the resulting construction as outlined in the above-described process. As will be further noted from a general inspection of FIG. 11, the hot/cold pad and base section assembly 110 results from the joining together of the material pieces in the above described process.

FIG. 12 shows, in part, the assembly of socket structure 50 by placing a first hot/cold pad and base section assembly 110 on top of a second hot/cold pad and base section assembly 110 such that each hot/cold pad and base section assembly 110 is perpendicular with the other and each socket base 70 is in alignment. The two socket bases 70 are then preferably joined together with stitching. Alternatively, the two pieces may be joined by other means of attachment known in the art, for example adhesive.

FIG. 13 shows, in part, further assembly of socket structure 50 by joining a pad side edge 66 to an adjacent pad side edge 66. The pad side edges 66 are then preferably joined together with stitching. Alternatively, the pad side edges 66 may be joined by other means of attachment known in the art, for example adhesive. As will be further seen from an inspection of FIG. 13, pad members 60 each comprise a superior edge 62, which superior edges 62 are preferably attached to inner periphery 28 by stitching. Alternatively, superior edges 62 may also be attached to inner periphery 28 by other means of attachment known in the art, for example adhesive.

FIG. 13 further shows a series of four pad members 60, preferably attached to socket base 70 at seam 74. Seam 74 is preferably of reduced thickness so that pad members may more easily fold or pivot along seam 74 as may be seen in FIGS. 12 and 13.

Figure 14:
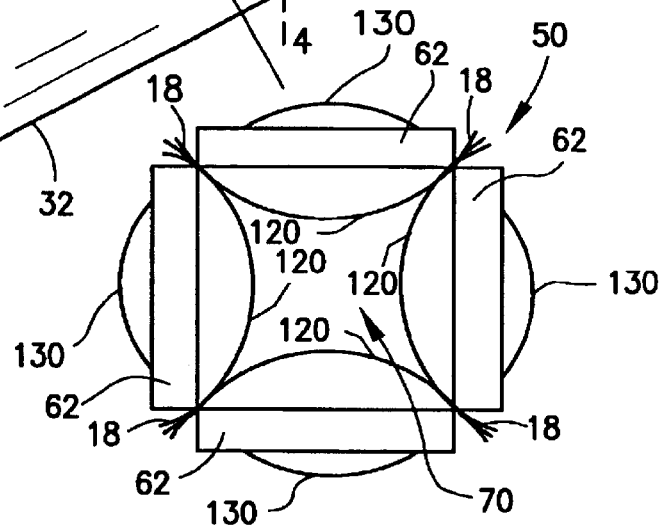
FIG. 14 is a top plan view of a hot/cold pad and base section assembly in an assembled state showing four hot/cold pads attached to one another, thus forming an insulative beverage container-holding structure.

FIG. 14 shows a top view of an assembled socket structure 50, wherein all pad side edges 66 are joined together. Socket structure 50 is completely assembled once all pad side edges 66 are joined together. As earlier indicated, pad side edges 66 are preferably joined together with stitching.

As comparatively shown in FIGS. 14 and 15, the assembled socket structure 50 is joined or attached to top sheet 20 at a point between top sheet 20 and base sheet 30. Socket structure 50 is thus positioned in approximately centerline alignment with the top sheet opening.

As can be seen from an inspection of FIGS. 16 and 17, socket base 70 preferably comprises two first pieces 120 and two second pieces 130. It is contemplated; however, that socket base 70 may alternatively comprise one or more first pieces 120 and one or more second pieces 130. It is further contemplated that socket base 70 may alternatively comprise a combination of first piece 120 and second piece 130. In the preferred embodiment, there is no insulation between first piece 120 and second piece 130. It should be noted, however that there may be insulation in between the four pieces namely the two first pieces 120 and the two second pieces 130.

FIGS. 16 and 17 comparatively show the assembled pillow with beverage container-holding orifice or socket structure in a first position (FIG. 16) and a second position (FIG. 17). FIG. 16 shows a cross-sectional view of a pillow 10 with socket structure 50 in an internal pillow position, thus defining an inwardly opening beverage container-holding orifice or beverage vessel-receiving socket structure, which is padded or pad-like to provide a flexible grabbing action upon a beverage container when the beverage container is placed into the socket structure 50. FIG. 17 shows a cross-sectional view of a pillow 10 with socket structure 50 in an external pillow position, thus defining an inverted socket structure to enable easier cleaning of the beverage container contact surfaces.

Alternative Embodiment

An alternative embodiment of the present invention concerns a pillow with a plurality of insulative beverage container-holding orifices or a plurality of insulated drink holders projecting into one side of the pillow as generally illustrated in FIG. 18. The alternative embodiment of the present invention is virtually identical to the preferred embodiment of the present invention save for the number of socket structures 50 projecting into one side of the pillow. As will be seen from an inspection of FIG. 18, two beverage containers may be placed through top sheet 20 into socket structure 50. It will thus be understood that our invention, as demonstrated by the disclosed alternative embodiment, may be used comfortably by a plurality of users. For example, two users may place the alternative embodiment between them and place beverage containers into the respective socket structures 50, thus enabling insulation of two beverages in a single embodiment.

The method of forming a pillow with an insulative beverage container holding orifice or socket structure or an integrated beverage holder generally comprises the steps of forming a pillow; forming an opening at the superior or top surface of the pillow at a spatial location inwardly of an outer boundary or approximately at the center of the top face of the pillow; forming an insulative beverage container-holding orifice or socket structure, which socket structure is to be placed into the opening in the pillow; placing the insulative beverage container-holding orifice or socket structure within the opening of the pillow such that the superior end of the insulative socket structure is substantially flush with the opening of the pillow; and securing the insulative socket structure to the pillow such that the insulative socket structure is in integral assembly with the pillow and the insulative socket structure defines an inwardly opening beverage container-holding orifice or socket structure or a beverage vessel-receiving socket structure.

The method of forming a socket structure generally comprises the steps of forming a first hot/cold pad and base section assembly; forming a second hot/cold pad and base section assembly to be attached to the first hot/cold pad and base section assembly; and securing a base section of the first hot/cold pad and base section assembly upon a base section of the second hot/cold pad and base section assembly such that the centerline of the first hot/cold pad and base section assembly is substantially perpendicular to the centerline of the second hot/cold pad and base section assembly. The pad sides are then preferably stitched to adjacent pad sides to form an assembled socket structure for receiving a beverage container. In this regard, it is further contemplated that the method of forming the socket structure may alternatively comprise the step of forming seams between the upright pad members, thus forming the socket structure in a unitary configuration.

Alternative Method and Kit

It is further contemplated that the concepts underlying the present invention may be utilized to convert existing pillows into pillows having insulative beverage container-holding orifices or socket structures. In this regard, the preferred method of converting existing pillows into pillows having insulative beverage container-holding orifices or socket structures preferably comprises a number of steps. In the first instance, the converter must make incisions 210 in the top face or superior face 220 of an existing pillow 200 in a region or spatial location where the converter wishes to insert a socket structure 50, as is generally illustrated in FIG. 19(*a*). After making incisions 210, the converter preferably manually repositions existent pillow fill material akin to filling material 40 from areas directly inferior to incisions 210 to areas in inferior adjacency to incisions 210 so as to provide a socket structure-receiving orifice 230 in the selected portion of the pillow 200 into which the converter wishes to insert a socket structure 50 as is generally illustrated in FIG. 19(*b*). Next, as illustrated in FIG. 19(*c*), a pillow slip cover 240 is provided, which slip cover 240 is sized and shaped to snugly encase pillow 200 to be converted. Slip cover 240 preferably comprises a socket structure 50 for insertion in socket structure-receiving orifice 230 and an open end 250 for receiving pillow 200 to be converted. Socket structure 50 is attached to slip cover 240 at a point that coincides with socket structure-receiving orifice 230. Similar to earlier descriptions, socket structure 50 is preferably attached to slip cover 240 by fabric stitching, although other methods of attachment known in the pertinent art may also be used, for example, the use of suitable adhesives and the like. Further, open end 250 of slip cover 240 preferably comprises zipper means 260 for closing open end 250 once pillow 200 to be converted is inserted into slip cover 240 as shown in FIG. 19(*c*). Finally, as generally illustrated in FIG. 19(*d*), after the converter inserts pillow 200 into slip cover 240, and inserts socket structure 50 into socket structure-receiving orifice 230, such that the fill material of pillow 200 holds socket structure 50 in a substantially fixed position, zipper means 260 is then zipped to finalize the steps of converting an existing pillow 200 into a pillow 300 having an insulative beverage container-holding orifice or socket structure.

It is contemplated that slip cover 240 may comprise decorative fabrics or be outfitted with amusing visual effects as desired. It is further contemplated that open end 250 need not comprise zipper means 260 to properly achieve the described conversion. Any suitable means of closing open end 250 may be utilized so long as the means of closing open end 250 effectively enables slip cover 240 to remain in a substantially pillow-encasing configuration.

It is further contemplated that the present invention may additionally embody a kit for converting an existing pillow into a pillow having an insulative beverage container-holding socket structure. In this regard, the kit preferably comprises a socket structure assembly, at least one piece of material for fixed attachment to an existing pillow, and means for fixedly attaching the socket structure assembly to the piece of material. The socket structure assembly may be described by preferably comprising a plurality of insulative pads or hot/cold pads in combination with a base section, which hot/cold pads and base section may be formed as described above. The insulative pads, as assembled, are thus sized and shaped to form a socket structure or to receive a beverage container. The kit may further comprise means for attaching at least one piece of material to an existing pillow. The means for attaching the socket structure assembly to a piece of material and the means for attaching at least one piece of material to an existing pillow preferably both comprise stitching materials, but may also comprise other attachment means known in the art, for example, adhesive means.

While the above descriptions contain much specificity, the specificity should not be construed as limitations on the scope of the invention, but rather as an exemplification of the invention. For example, so long as socket structure 50 is effectively mounted in a pillow for enabling users to place beverage containers in socket structure 50 as desired, it is believed the spirit of the present invention is accomplished. In this regard, for further example, the method of converting an existing pillow into a pillow having an insulative beverage container-holding orifice or socket structure 50 may comprise providing a socket structure 50 integrally formed with a piece of fabric sized and shaped to attach (by stitching or adhesive means, etc.) to top surface or superior surface 220 in a visually appealing manner. As indicated, so long as socket structure 50 may be inserted into some type of socket structure-receiving orifice and remain in a substantially fixed position for enabling users to place beverage containers therein, the present invention is achieved.

Accordingly, although the invention has been described by reference to a preferred embodiment and an alternative embodiment, it is not intended that the novel device be limited thereby, but that modifications thereof are intended to be included as falling within the broad scope and spirit of the foregoing disclosure, the following claims and the appended drawings.

We claim:

1. A pillow for holding a beverage container in a substantially upright position over pillow supporting surfaces, the pillow comprising:

a base sheet with a defined outer base sheet periphery having an outer base sheet surface and an inner base sheet surface;

a top sheet with a defined outer top sheet periphery having an outer top sheet surface and an inner top sheet surface positioned in approximately centerline alignment with the base sheet;

means of attaching the base sheet outer periphery to the top sheet outer periphery with the inner base sheet surface facing the inner top sheet surface;

a top sheet opening, adapted for insertion of a beverage container through the top sheet;

a socket structure defining a socket adapted for holding a beverage container in a substantially unright position with an outer socket surface and an inner socket surface, the socket structure comprising a base pad and four sidewall pads;

means for attaching the socket structure to the top sheet opening; and a filling material sized, shaped and positioned to exert a force against the inner base sheet surface, the inner top sheet surface, and the inner socket surface of the base pad and at least one sidewall pad wherein each of the four sidewall pads comprises:

a socket base;

a socket sidewall extending from the socket base; and a socket opening defined by the socket sidewall;

wherein the socket structure sidewall comprises:

a first sheet with a defined first sheet outer periphery, an inner first sheet surface, and an outer first sheet surface;

a second sheet with a defined second sheet outer periphery, an inner second sheet surface, and an outer second sheet surface; means of attaching the first sheet outer periphery to the second sheet outer periphery with the inner first sheet surface facing the inner second sheet surface;

and further comprising padding located between the first and the second sheet to provide flexibility.

2. The pillow of claim 1, wherein the means of attaching the base sheet outer periphery to the top sheet outer periphery comprises fabric stitching.

3. The pillow of claim 1, wherein the means for attaching the socket structure to the top sheet opening comprises fabric stitching.

4. The pillow of claim 1, wherein the socket structure further comprises padding adapted to provide a flexible grabbing action upon a beverage container when the beverage container is placed into the socket.

5. The socket structure of claim 1, wherein the outer socket surface comprises waterproof material.

6. A combination pillow and hot/cold insulative drink holder, the combination comprising:

a top sheet and a base sheet on opposite sides with cushioning material in between the top sheet and the base sheet in assembled relation;

means securing the top sheet and the base sheet together;

an insulative drink holder projecting into the top sheet, the insulative drink holder comprising hot/cold padding and a support base, the hot/cold padding comprising a first sheet and a second sheet on opposite sides with hot/cold insulation material in between the first sheet and the second sheet, the first sheet comprising a waterproof material, the hot/cold padding formed into a series of five pads, the five pads including four side wall pads and one bottom pad, the five pads being joined to one another at seams, the side wall pads being folded along the seams in upright relation to the bottom pad, the hot/cold padding peripherally bounding the beverage vessel-receiving socket structure with a superior end and an inferior end, the support base comprising a peripheral edge, the peripheral edge being attached to the inferior end of the hot/cold padding, the cushioning material exerting forces against the top sheet, the base sheet, and the five pads at the second sheet; and means securing the insulative drink holder in integral assembly with the top sheet.

7. The combination of claim 6 wherein the insulative drink holder is invertable, the invertable insulative drink holder being in an external pillow position when inverted thus defining an inverted beverage vessel-receiving socket structure to enable a user to clean the first sheet.

8. The combination of claim 6, wherein the hot/cold insulation material is adapted to provide a flexible grabbing action upon a beverage container when the beverage container is placed into the beverage vessel-receiving socket structure.

9. The combination of claim 6 wherein the top sheet and the base sheet each comprise waterproof material.

10. The combination of claim 6 wherein the cushioning material comprises an insulative material.

11. The combination of claim 6 wherein the insulative drink holder is center-mounted.

12. A pillow for maintaining the temperature of a beverage, the beverage being contained in a substantially upright beverage container, the pillow comprising:

a top sheet, a base sheet, an invertable container-holding socket structure, filling material, and attachment means, the top sheet comprising an inner periphery, the container-holding socket structure comprising a superior open end and an inferior socket base end, the container-holding socket structure being formed of four rectangular, sidewall pad members and a rectangular bottom pad member, each sidewall pad member comprises a superior edge, an inferior edge, and two side edges, the bottom pad member comprises four peripheral edges, the attachment means joining the side edges to one another at substantially upright seams, the attachment means joining the inferior edges to the peripheral edges at substantially horizontal seams, the attachment means attaching the superior edges to the inner periphery, the socket structure having an inner socket surface and an outer socket surface, the fill material being disposed intermediate the top sheet, the bottom sheet and the outer socket surface, the fill material exerting force against the top sheet, the bottom sheet and the outer socket surface, the sidewall pad members comprising hot/cold insulation material, the hot/cold insulation material being intermediate the inner socket surface and the outer socket surface, the inner socket surface comprising a waterproof material, the hot/cold insulation material for maintaining the temperature of the beverage when the beverage container is inserted into the container-holding socket structure, the inner socket surface being in an external pillow position when the container-holding socket structure is inverted for enabling a user to clean the inner socket surface.

13. The pillow of claim 12, wherein the hot/cold insulation material is adapted to provide a flexible grabbing action upon the beverage container when the beverage container is placed into the container-holding socket structure.

14. The pillow of claim 12 wherein the top sheet and the bottom sheet each comprise waterproof material.

15. The pillow of claim 12 wherein the bottom pad member comprises hot/cold insulation material.

16. The pillow of claim 12 wherein the filling material comprises an insulative material.

17. The pillow of claim 12 wherein the inner periphery is substantially centered.

18. A pillow for holding a beverage container in a substantially upright position over pillow supporting surfaces, the pillow comprising:

a base sheet, the base sheet comprising an outer base sheet periphery, an outer base sheet surface, and an inner base sheet surface;

a top sheet, the top shoot comprising an outer top shoot periphery, an inner top shoot periphery, an outer top sheet surface, and an inner top sheet surface, the inner base sheet surface facing the inner top sheet surface, the inner top sheet periphery adapted for receiving a beverage container;

a container-holding socket structure, the container-holding socket structure adapted for holding the beverage container received by the inner top sheet periphery, the container-holding socket structure comprising a superior open end and an inferior socket base end, the container-holding socket structure being formed of four rectangular, sidewall pad members and a rectangular bottom pad member, each sidewall pad member comprising a superior edge, an inferior edge, and two side edges, the bottom pad member comprises four peripheral edges, the attachment means joining the side edges to one another at substantially upright seams, the attachment means joining the inferior edges to the peripheral edges at substantially horizontal seams, the attachment means attaching the superior edges to the inner periphery, the container-holding socket structure having an inner socket surface and an outer socket surface, the fill material being disposed intermediate the top sheet, the bottom sheet and the outer socket surface, the fill material being sized, shaped and positioned to exert forces against the inner top sheet surface, the inner base sheet surface, and the outer socket surface, the sidewall pad members comprising hot/cold insulation material, the hot/cold insulation material being intermediate the inner socket surface and the outer socket surface, the hot/cold insulation material being adapted to provide a flexible grabbing action upon the beverage container when the beverage container is placed into the container-holding socket structure, the inner socket surface comprising a waterproof material, the sidewall pad members and the bottom pad member for maintaining the beverage container in a substantially upright position over pillow supporting surfaces when the beverage container is inserted into the container-holding socket structure; and attachment means, the attachment means for attaching the superior open end to the inner top sheet periphery and for attaching the base sheet outer periphery to the top sheet outer periphery.

19. The pillow of claim 18 wherein the container-holding socket structure is invertable, the inner socket surface being in an external pillow position when the container-holding socket structure is inverted for enabling a user to clean the inner socket surface.

20. The pillow of claim 18 wherein the top sheet and the bottom sheet each comprise waterproof material.

21. The pillow of claim 18 wherein the bottom pad member comprises hot/cold insulation material.

22. The pillow of claim 18 wherein the filling material comprises an insulative material.

23. The pillow of claim 18 wherein the container-holding socket structure is positioned in substantially centerline alignment with the top sheet outer periphery.

24. The pillow of claim 1 wherein the socket is positioned in approximately centerline alignment with the top sheet opening.

* * * * *